United States Patent [19]

Hooser

[11] 4,432,451

[45] Feb. 21, 1984

[54] BATHROOM ACCESSORY

[76] Inventor: Oneida O. Hooser, 313 N. Church (Brooklyn), Mooresville, Ind. 46158

[21] Appl. No.: 473,530

[22] Filed: Mar. 9, 1983

[51] Int. Cl.[3] ..... B65D 85/67

[52] U.S. Cl. ..... 206/216; 206/225; 206/394; 206/804; 312/42; 312/45; 312/206; 242/55.53

[58] Field of Search ..... 206/394, 216, 225, 804, 206/389; 312/206, 42, 45; 242/53.53

[56] References Cited

U.S. PATENT DOCUMENTS 2,534,290 12/1950 Moskowitz ..... 206/394

3,275,133 9/1966 Wood ..... 206/394

4,273,393 6/1981 Stinson ..... 206/394

*Primary Examiner*—William T. Dixson, Jr.

*Attorney, Agent, or Firm*—Robert A. Spray

[57] ABSTRACT

A bathroom accessory in the form of a canister for convenient storage of extra rolls of toilet tissue and a suction type plunger device, the compactness being provided by providing that the plunger handle is nested in the hollow core of the tissue rolls being stored, and a lifting means for the stored rolls being provided which is actuatable entirely from the exterior of the device even though it has a roll-raising effect throughout an extended range of lifting movement for the rolls.

10 Claims, 2 Drawing Figures

BATHROOM ACCESSORY

Figure 1:
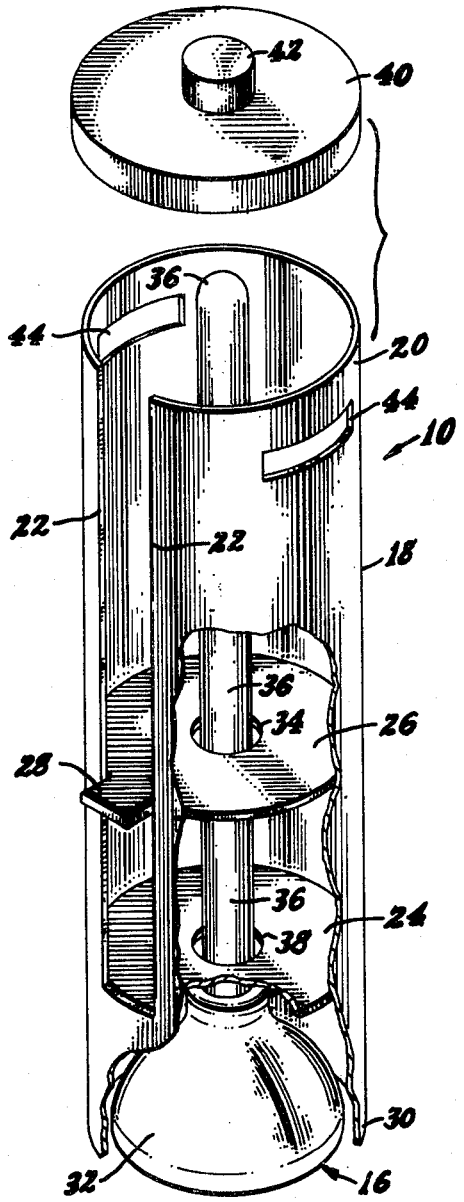

This invention relates to a bathroom accessory, and more particularly to a device and means for storing extra rolls of toilet tissue and a suction-type plunger in a manner which is quite both advantageous and attractive.

Even more particularly, the concepts of this invention provide such a novelty and attractiveness of storage for these "bathroom items," which are obviously both quite desirable and are desirably present in close proximity to a bathroom commode, that these items may be stored attractively even immediately and handily adjacent the commode, in spite of the fact that such items are of rather special shape and are so obviously of functional nature and purpose that they would not otherwise be kept so handy to the commode even though are very desirably kept quite handy to the commode.

Concepts of the invention also provide an attractiveness and "functional disguisement" of the storage of both extra rolls of tissue and a toilet plunger that they may be kept stored immediately adjacent the bathroom commode, even though there is usually a very limited amount of space in the bathroom, at least in the sense of storage space of cabinet type closely adjacent the commode.

Suction type plungers are so functionally-looking in appearance, that they are considered as ugly and even almost gruesome either as to the homeowner's own opinion or as to a supposition of the opinion of a visitor to the home, that an etiquette-conscious or attractiveness-conscious homeowner would not likely keep a plunger close to the commode even though that is precisely the desired location for it; and for similar reasons such a homeowner would not likely keep extra rolls of toilet tissue adjacent the commode even though that is precisely the desired location for extra rolls.

Accordingly, the present invention provides an attractive container device, for containing yet disguising the presence of extra rolls of toilet tissue and a suction type toilet plunger, in a space-saving manner such that the handle of the plunger is nested within the hollow core of the extra tissue rolls, and with the container being such that the plunger may be quickly and in fact immediately accessible regardless of the presence of tissue rolls stored above it in the container, and with an ease of removal of extra tissue rolls without having to reach down into the container.

Although not at all objectionable-looking, its commode-adjacent presence and its general shape may suggest the presence of a spare roll of tissue, particularly advantageous when a guest is visiting the home; and it can even be of a "decorator-color" and/or a "decorator-design", matching other accessories of a bathroom ensemble.

Figure 2:
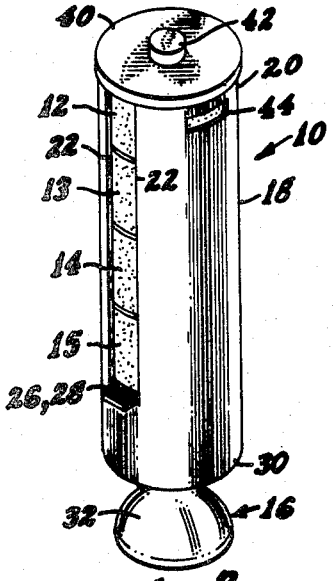

The above description is of somewhat introductory and generalized form. More particular details, concepts, and features of the invention are set forth in the following and more detailed description of an illustrative embodiment, taken in conjunction with the accompanying drawings, which are of somewhat diagrammatic nature, and in which the invention's embodiment and novel concepts are illustratively presented, and to which the following description makes reference:

FIG. 1 is a pictorial view of a cannister device according to the inventive concepts. It is of exploded nature to illustrate the relation of the lid and the enclosure housing components, the exploded nature, and the portions conventionally shown as broken away, being to illustrate interior details otherwise hidden; and FIG. 2, in somewhat smaller scale, is a pictorial view showing the enclosure housing in an intermediate position, i.e., a position in which it and rolls of toilet tissue stored therein are being lifted off of the plunger device.

As shown in the drawings, the concepts of this invention provide a canister device 10 for the storage of toilet tissue in rolled form, as shown by rolls 12–15, and also for storage of a suction type plunger device 16, thus to provide advantageous and attractive and concealed storage of those items handy to a bathroom commode, as discussed above.

The canister device 10 has, as its largest and overall component, a generally cylindrical enclosure housing 18; and the housing 18 is of an internal diameter large enough to accommodate the diameter of a roll of toilet tissue shown as rolls 12–15, although desirably for compactness not much larger than needed for such rolls 12–15, stacked atop one another.

As shown, the housing 18 is open at its upper end 20, and as shown is provided with a slot 22 which extends downwardly from the upper end 20 of the housing 18, continuously a length at least as long as the length of a roll 12 of the tissue, and the lengths of the four rolls 12–15 in the desired four-roll embodiment shown.

There are tray-support means 24 located inwardly of the housing 18; and the support means 24 is shown as a disc extending across the interior of the housing 18.

There is provided a movable tray member 26 supported by the tray-support means 24, also inwardly of the housing; and the tray member 26 is shown as having a lug 28 which extends outwardly of the slot 22 of the housing 18 when the tray member 26 is positioned in the housing 18, the lug 28 providing a manually graspable handle for the tray 26 by which it and one or more rolls 12–15 of tissue as may be supported thereon may be raised to an upward position such that the roll(s) 12–15 of tissue may be grasped from above the upper end 20 of the housing 18 without the user having to awkwardly reach downwardly into the housing 18 to try to grasp one or more of the rolls 12–15 from the housing 18.

It is to be particularly noted that the lower end 30 of the housing 18 is also open, and the location of the tray-support means 24 for the tray member 26 is located such that the tray-support means 24 and the tray member 26 (when the tray member 26 is supported on the support 24) are significantly spaced above the lower end 30 of the housing 18. That spacing is an amount sufficient to accommodate the suction cup 32 of the associated suction type plunger device 16, and thus the plunger device 16 is accessible by merely lifting the housing upwardly of the plunger device 16.

It is further to be noted that the tray member 26 is provided with a central opening means 34 which is accommodative of the passage therethrough of the handle 36 of the associated plunger device 16 when the plunger device 16 is positioned within the housing 18 and with the handle 36 thereof extending generally axially of the housing and through the core(s) of the rolled tissue 12–15 being stored in the housing 18 and supported by the tray member 26. If the support means 24 is a continuous shelf-like member, it too has a central opening 38 similar to opening 34 of the tray 26, for accommodating the plunger handle 36.

The device 10 thus is quite useful as a bathroom accessory, for it provides handy storage of the plunger 16 and rolls 12–15 even though they are of an appearance which would preclude their storage so handily except for this advantageous device and its nesting-type of storage nature.

It will be noted that the plunger 16 is stored within the housing 18 in an upright position in which the plunger device 16 handle extends upwardly, ready for instant grabbing when needed.

Also, the roll(s) of toilet tissue 12–15 positioned in the housing 18 are positioned in a manner that the axis of the rolls 12–15 is upright, for ease of picking up when brought by the handle lug 28 to elevated position with the upper of the stored rolles 12–15 above the housing 18.

The support means 24 may be of whatever form is desired, but with an access 38 for accommodating the plunger handle 36, and located on the housing 18 high enough for supporting the roll 12–15 of tissue above the plunger's suction cup 32.

The width and nature of the slot 22 is not critical, but it is shown accommodating the lug 28 as an actuator means provided exteriorly of the enclosure housing 18, so that the roll-lifting tab 28 is actuatable by manual actuation applied exteriorly of the housing 18, and the actuator means 28 are movable along the slot 22 a distance corresponding to the distance the roll(s) of toilet tissue 12–15 is/are moved in being raised from stored position to the upwardly-graspable position above the upper end 20 of the housing 18.

It will be noted, as shown, that the wall slot 22 provides means which accommodate the movement of the actuator tab means 28 throughout its entire range of movement even though the application of the actuation force to the tab 28 is applied exteriorly of the housing 18 throughout the entire range of movement of the actuator tab 28 and tray 26, and the actuator tab 28 has its roll-lifting effect applied interiorly of the housing 18 throughout the entire range of movement of the roll(s) of tissue 12–15 from stored position within the enclosure 18 to the upwardly-graspable position of the roll(s) 12–15.

The compactness of the housing 18 is such, particularly in its upper portion in which the roll(s) of toilet tissue 12–15 is/are stored, that with a roll 12–15 positioned in the housing 18 it would be difficult for a person to get his or her fingers along the side of the toilet tissue roll 12–15 to grasp the roll for removal. This adds to the smallness of the device 10, and the nesting relation of the plunger handle 36 in the core of the stored rolls 12–15 also achieves compactness of size, so that the device 10 is conveniently kept closely adjacent the bathroom's commode, particularly handy for use of either a stored roll or the plunger 16.

Desirably, a cover lid 40 is provided, preferably with an upraised center section 42 for attractiveness and for accommodating a plunger handle 36 of extra length. Also handle means 44 are provided adjacent the top 20 of the housing 18, for facilitating picking it up off the plunger 16.

It is thus seen that a novel storage device according to the inventive concepts herein set forth provides desired and advantageous storage of extra rolls of toilet tissue and a suction type toilet plunger device.

Accordingly, it will thus be seen from the foregoing description of the invention according to this illustrative embodiment, considered with the accompanying drawings, that the present invention provides new and useful concepts of a novel and advantageous storage canister for such items providing the advantages of attractive storage of them closely adjacent a bathroom commode, and providing special utility from various standpoints such as pointed out herein, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. A cannister device for storage of toilet tissue in rolled form, comprising:

a generally cylindrical enclosure housing, of an internal diameter large enough to accommodate the diameter of a roll of toilet tissue;

the housing being open at its upper end, and provided with a slot extending downwardly from its upper end continuously a length at least as long as the length of a roll of said tissue;

tray-support means located inwardly of the housing; and a movable tray member supported by said tray-support means, and inwardly of the housing;

the tray member having a lug which extends outwardly of the slot of the housing when the tray member is positioned in the housing, and providing a manually graspable handle for the tray by which it and a roll of tissue supported thereon may be raised to an upward position such that the roll of tissue may be grasped from above the upper end of the housing without reaching downwardly into the housing.

2. The invention as set forth in claim 1, in a combination in which the lower end of the housing is also open, the location of the tray-support means for the tray member being such that the tray-support means and the tray member when supported thereon are spaced above the lower end of the housing an amount, within the housing and below the tray member when it is being supported on the tray-support means, sufficient to accommodate the suction cup of an associated suction type plunger device, the plunger device being accessible by lifting the housing upwardly of the plunger device.

3. The invention as set forth in claim 2 in a combination in which the tray member is provided with an opening means accommodative of the passage therethrough of the handle of the associated plunger device, when it is positioned within the housing and with the handle thereof extending generally axially thereof and through the core of the rolled tissue being stored in the housing and supported by the tray member.

4. A cannister device as a bathroom accessory, comprising:

an enclosure housing open at both ends, the housing accommodating an associated suction type plunger device, having a suction cup and a handle, stored within the housing in an upright position in which the plunger device handle extends upwardly, the housing also accommodating a roll of toilet tissue positioned therein in a manner that the axis of the roll is upright, and the roll is above the suction cup of the associated plunger device, thereby providing for the enclosed storage of a roll of toilet tissue and an associated type plunger device, with the handle of the associated plunger device extending through the core of the rolled tissue being stored in the housing.

5. The invention as set forth in claim 4 in a combination in which support means are carried by the housing for supporting the roll of tissue above the suction cup of the associated plunger device.

6. The invention as set forth in claim 5 in a combination in which roll-lifting means are provided by which the roll of toilet tissue may be raised upwardly with respect to the enclosure housing such that the roll of tissue may be grasped from above the upper end of the housing without reaching downwardly into the housing.

7. The invention as set forth in claim 6 in a combination in which actuator means are provided exteriorly of the enclosure housing by which the roll-lifting means are actuatable by manual actuation applied exteriorly of the housing.

8. The invention as set forth in claim 7 in a combination in which an actuator means are movable along a distance corresponding to the distance the roll of toilet tissue is moved in raising it from stored position to said upwardly-graspable position, and the enclosure is provided with accommodation means which accommodate said movement of the actuator means throughout its said range of movement even though (a) the acutator means are of a nature such that the application of the actuation force thereof is applied exteriorly of the housing throughout said range of movement of the actuator means, and (b) the actuator means has its roll-lifting effect applied interiorly of the housing throughout the entire range of movement of the roll of tissue from its stored position within the enclosure to its said upwardly-graspable position.

9. The invention as set forth in claim 7 in a combination in which the shape of the housing, in its upper portion in which the roll of toilet tissue is stored, is of a compact nature such that with a roll positioned in the housing it would be difficult for a person to get his or her fingers along the side of the toilet tissue roll to grasp the roll for removal.

10. The invention as set forth in claim 8 in a combination in which the shape of the housing, in its upper portion in which the roll of toilet tissue is stored, is of a compact nature such that with a roll positioned in the housing it would be difficult for a person to get his or her fingers along the side of the toilet tissue roll to grasp the roll for removal.

* * * * *

UNITED STATES PATENT AND TRADEMARK OFFICE

CERTIFICATE OF CORRECTION

PATENT NO. : 4,432,451

DATED : February 21, 1984

INVENTOR(S) : Oneida O. Hooser

It is certified that error appears in the above—identified patent and that said Letters Patent is hereby corrected as shown below:

On the Title Page, correct the Number of the Stinson patent to: 4,273,392

Col. 3, line 13: Correct the spelling of "rolls".

Col. 4, last line: After "associated" insert: -- suction -- .

Signed and Sealed this

*Eighth* Day of *May 1984*

[SEAL]

*Attest:*

GERALD J. MOSSINGHOFF

*Attesting Officer*

*Commissioner of Patents and Trademarks*